US009227458B2

(12) United States Patent
Kelly

(10) Patent No.: US 9,227,458 B2
(45) Date of Patent: Jan. 5, 2016

(54) SEE-SCROLL DISPLAY APPARATUS AND METHOD OF ASSEMBLY

(71) Applicant: STRUCTURAL GRAPHICS, LLC, Essex, CT (US)

(72) Inventor: Charles R. Kelly, Wilmington, DE (US)

(73) Assignee: Structural Graphics, LLC, Essex, CT (US)

( * ) Notice: Subject to any disclaimer, the term of this patent is extended or adjusted under 35 U.S.C. 154(b) by 0 days.

(21) Appl. No.: 14/425,243

(22) PCT Filed: Sep. 12, 2013

(86) PCT No.: PCT/US2013/059407

§ 371 (c)(1),
(2) Date: Mar. 2, 2015

(87) PCT Pub. No.: WO2014/043319

PCT Pub. Date: Mar. 20, 2014

(65) Prior Publication Data

US 2015/0266329 A1 Sep. 24, 2015

Related U.S. Application Data

(60) Provisional application No. 61/700,068, filed on Sep. 12, 2012.

(51) Int. Cl.

| | |
|---|---|
| ***B42D 15/04*** | (2006.01) |
| ***G09F 3/08*** | (2006.01) |
| ***G09F 1/08*** | (2006.01) |

(52) U.S. Cl.

CPC ..... *B42D 15/047* (2013.01); *G09F 1/08* (2013.01); *G09F 3/08* (2013.01); *G09F 2001/085* (2013.01); *Y10T 29/49826* (2015.01)

(58) Field of Classification Search

CPC .... B42D 15/045; B42D 15/042; B42D 15/04; G09F 1/04; G09F 1/00; G09F 1/10; G09F 23/10; G09F 1/08; G09F 3/08

USPC ..... 40/124.191, 124.05, 124.06

See application file for complete search history.

(56) References Cited

U.S. PATENT DOCUMENTS

| | | | | | |
|---|---|---|---|---|---|
| 1,699,383 | A * | 1/1929 | Taylor | G09F 1/04 | 40/491 |
| 2,505,846 | A | 5/1950 | Anderson | | |
| 3,199,238 | A * | 8/1965 | Brown | G09F 11/00 | 40/488 |
| 3,848,348 | A * | 11/1974 | Hawley | G09F 11/26 | 40/445 |
| 3,946,508 | A * | 3/1976 | Booras | G09F 1/04 | 229/71 |
| 5,337,949 | A * | 8/1994 | Seeley | A47G 1/141 | 229/84 |
| 5,409,381 | A * | 4/1995 | Sundberg | G09B 1/02 | 434/159 |
| 5,611,161 | A * | 3/1997 | Murphy | B42D 15/042 | 116/321 |

(Continued)

*Primary Examiner* — Shin Kim

(74) *Attorney, Agent, or Firm* — Ware, Fressola, Maguire & Barber LLP

(57) ABSTRACT

A display assembly in the form of a sleeve envelops a central subpart, a loop that envelops the central subpart, and a pull tab panel part. An opening is provided on one side edge of the sleeve to allow the pull tab to be pulled out in a pull out direction. The act of pulling out the pull tab panel part causes the loop to be pulled on a side attached to the pull out tab part in the same direction so as to cause it to traverse around the central subpart. A cutout window on the front of the sleeve displays printed matter on the loop moving, with respect to the other side of the central subpart, in a direction opposite that of the pull out direction.

11 Claims, 3 Drawing Sheets

(56) References Cited

U.S. PATENT DOCUMENTS 6,061,938 A * 5/2000 Young ..... G09F 11/00 116/321
7,363,738 B2 * 4/2008 Burtch ..... G09F 11/00 116/324
7,694,445 B2 * 4/2010 Kelly ..... G09F 1/04 40/124.08
8,322,058 B2 * 12/2012 Mayer ..... B42D 15/022 40/124.03
8,919,018 B2 * 12/2014 Udovic ..... G09F 1/04 40/124.06
2005/0278997 A1 * 12/2005 Burtch ..... G09F 11/00 40/491
2006/0168851 A1 8/2006 Hluchan
2008/0156686 A1 7/2008 Hluchan et al.
2008/0313941 A1 * 12/2008 Kelly ..... G09F 1/04 40/411
2011/0099863 A1 5/2011 Burtch
2012/0285967 A1 * 11/2012 Glass ..... B42D 15/027 220/345.1

* cited by examiner

SEE-SCROLL DISPLAY APPARATUS AND METHOD OF ASSEMBLY

BACKGROUND

Several image changing mechanisms exist in the advertising and promotional display field. These devices in the most basic sense will first display one image and then replace it with another (secondary) image as the device is activated by the user.

Many of the aforementioned class of image changing mechanisms are restricted to the maximum size of the image area due to the size requirements of the necessary (hidden) components of the mechanism. In addition to this, many like mechanisms reveal the secondary image(s) in a predictable manner.

SUMMARY

According to a first aspect of the present invention, a method comprises slipping a printed flexible loop onto a central subpart of a foldable panel part that is foldable along a fold line between the central subpart and a window subpart of the foldable panel part, attaching a pull tab panel part onto an outside surface of the printed flexible loop, folding the central subpart with the pull tab panel part attached to the printed flexible loop so as to bring the central subpart into parallel alignment with the window subpart, folding a back subpart of the foldable panel part along a fold line between the back subpart and the window subpart so as to bring the back subpart into parallel alignment with the central subpart and the window subpart, and attaching the window subpart to the back subpart so as to form a flat panel display assembly sleeve with the central subpart and the pull tab panel part inside the sleeve between the window subpart and the back subpart with the pull tab panel part slideable in and out of the flat panel display assembly sleeve at an open end opposite an end defined by the fold line between the back subpart and the window subpart so that an inside surface of the printed flexible loop slides on an outside surface of the central subpart and the printed matter on the printed flexible loop moves with respect to the central subpart in traversing a cutout window of the window subpart.

According to the first aspect of the present invention, the printed flexible loop may be a thin, flexible material such as a printed plastic loop.

In accordance with the first aspect of the present invention, the method may further comprise forming the printed flexible loop by attaching an edge on one side of the printed flexible loop onto an opposite side of the printed flexible loop.

Further in accordance with the first aspect of the present invention, the central subpart may have printed matter thereon and the film is transparent, at least in part, so that the printed matter on the printed plastic film is caused to visibly move with respect to the printed matter on the central subpart.

In further accord with the first aspect of the present invention, the printed matter may be opaque.

In still further accord with the first aspect of the present invention the pull tab panel part may have printed matter thereon that is visible when slid out of the sleeve.

According to a second aspect of the present invention, an apparatus comprises:

a printed flexible loop slipped onto a central subpart of a foldable panel part that is folded along a fold line between the central subpart and a window subpart into parallel alignment with the window subpart;

a pull tab panel part attached onto an outside surface of the printed flexible loop, the central subpart with the flat pull tab panel part attached to the printed flexible loop folded into said parallel alignment with the window subpart;

a back subpart of the foldable panel part folded along a fold line between the back subpart and the window subpart into parallel alignment with the central subpart and the window subpart; and the window subpart attached to the back subpart so as to form a flat panel display assembly sleeve with the central subpart and the pull tab panel part inside the sleeve between the window subpart and the back subpart with the pull tab panel part slideable in and out of the flat panel display assembly sleeve at an open end opposite an end defined by the fold line between the back subpart and the window subpart so that an inside surface of the printed flexible loop is slideable on an outside surface of the central subpart to cause the printed matter on the printed plastic film move with respect to the central subpart in traversing a cutout window of the window subpart.

According to the second aspect of the present invention, the printed flexible loop may be a thin, flexible material such as a printed plastic loop.

In accordance with the second aspect of the present invention, the apparatus may further comprise an edge on one side of the printed plastic film attached onto an opposite side of the printed plastic film to form the printed flexible loop.

In further accord with the second aspect of the present invention, the central subpart has printed matter thereon and the film is transparent, at least in part, so that the printed matter on the printed plastic film is caused to move with respect to the printed matter on the central subpart.

Further in accordance with the second aspect of the present invention, the printed matter is opaque.

Still further in accord with the second aspect of the present invention, the pull tab panel part may have printed matter thereon that is visible when slid out of the sleeve.

According to a third aspect of the present invention, a display assembly comprises a sleeve that envelops a central subpart, a loop on the central subpart, and a pull tab panel part attached to the loop, wherein an opening is provided on one side edge of the sleeve to allow the pull tab panel part to be pulled out in a pull out direction that causes the loop to be pulled in the same direction so as to cause the loop to traverse around the central subpart, wherein a cutout window on the front of the sleeve displays printed matter on the loop moving, with respect to an other side of the central subpart, in a direction opposite that of the pull out direction.

DETAILED DESCRIPTION

Figure 1:
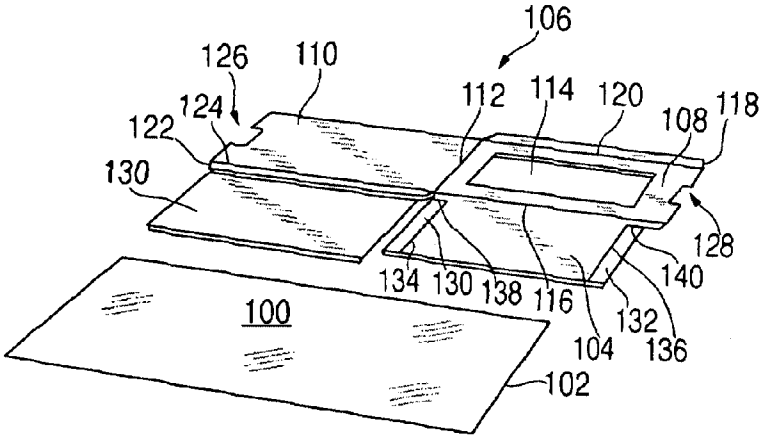
FIG. 1 shows an illustration of various unassembled parts of an apparatus, according to the present invention.
Figure 2:
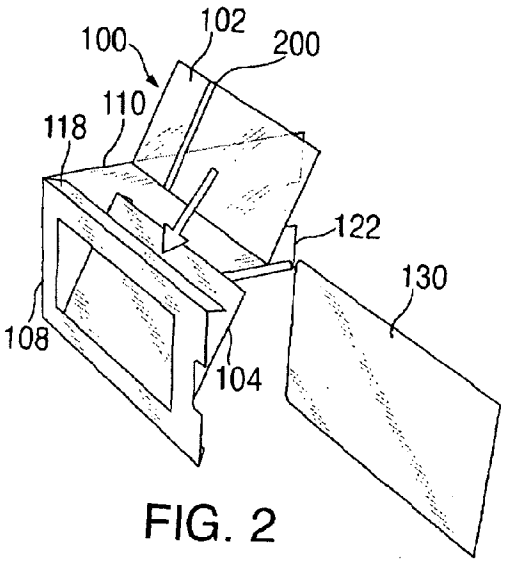
FIG. 2 shows initial assembly steps, according to an embodiment of an assembly method according to the present invention.
Figure 3:
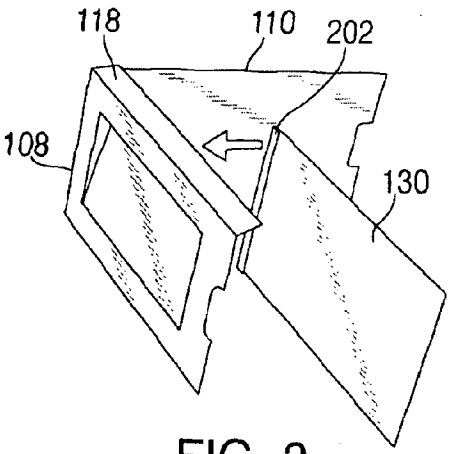
FIG. 3 shows further assembly steps, according to the embodiment of an assembly method according to the present invention.
Figure 4:
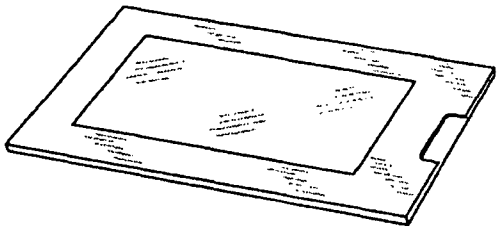
FIG. 4 shows an apparatus assembled according to the exemplary method of FIGS. 2 and 3.

FIG. 1 shows unassembled parts of an apparatus according to an embodiment of the present invention that may be assembled according to a method shown in FIGS. 2-3 to form the assembly shown in FIG. 4. In particular, FIG. 1 (not to scale) shows a thin, flexible part 100 that has artwork printed on at least one surface thereof. The thin, flexible part 100 may be a thin, flexible material such as but not limited to plastic, paper, or fabric. It may be planar in form and have a rectangular shape such as a rectangular panel or sheet. Such a thin, flexible part 100 may be a thin, flexible material that is nonetheless resistant to wrinkling. It may have a thickness of, for instance, 1.5 millimeter. Of course, other thicknesses may be used so long as the thin, flexible part 100 can be slid along a surface, as described below, without breaking, wrinkling, or otherwise deforming. Such a thin, flexible part 100 may be transparent. In that case, the artwork or printed matter may be opaque or partially transparent. The thin, flexible part 100 may be a film such as a plastic film. The thin, flexible part 100 may be wrapped around a central subpart 104 of an L-shaped part 106 having a window subpart 108 and a back subpart 110. The wrapped around thin, flexible part 100 forms an endless printed flexible loop or belt supported by the central subpart that acts as a support panel. The L-shaped part 106 may be of a high quality paper board such as Solid Bleached Sulfate (SBS) stock used for high end packaging where the quality of printed image is required to be at a high level. A fold line 112 may separate the back subpart from the window subpart 108. Such a fold line may be scribed on the L-shaped part 106 to assist in folding. The window subpart may have at least one window cutout 114. A fold line 116 may separate the central subpart 104 from the window subpart 108. The subparts 104, 108 and 110 may be rectangular in shape and of roughly the same size for parallel alignment after folding operations described below in connection with FIGS. 2 and 3. As described more fully below, the central subpart becomes sandwiched in between the window subpart and the back subpart. A top tab 118 of the window subpart is foldable ninety degrees on a fold line 120 so as to face the inside of back subpart when folded into parallel alignment with the window subpart in the final assembly. Likewise, a bottom tab 122 of the back subpart is foldable on a fold line 124 to face the bottom of the underside of the window subpart shown in FIG. 1, i.e., to face a section between fold line 116 and cut lines 138, 140. A finger cutout 126 in the back subpart aligns with a finger cutout 128 in the window subpart when the back subpart is folded over and brought into parallel alignment with the window subpart. Side tabs 130, 132 of the central subpart 104 may be provided as defined by fold lines 134, 136. Cut lines 138, 140 permit the side tabs to be folded over and rotated one hundred and eighty degrees about the fold lines 134, 136 and glued to a side of the central subpart. It is preferred to fold the tabs in the direction away from the window so they are glued to the underside of the central subpart 104 shown in FIG. 1 so as not to be visible through the window cutout 114. This provides a smooth (rounded/radiused) edge at each end for the thin, flexible part 100 to slide on when moving in a looping fashion around the central subpart. Without such a smooth edge, the thin, flexible part 100 would in operation course around in looping fashion and change direction by a hundred and eighty degrees after traversing ("turning the corner" around) a rectangular paper board edge. A pull tab panel part 130 is shown and may also be rectangular in shape, as shown, and about the same size as the subparts 104, 108, 110 of the L-shaped part 106 although of course slightly smaller in order to fit within the assembly and to be able to slide in and out. For instance, if the assembly is 5.375 inches wide, the pull tab could be 5.25 inches wide and be able to fit comfortably inside and moreover moveable when pulled out or pushed back in. A specimen examined for the purpose of drafting this specification was 7 inches long and had a rectangular window cutout of 4 by 4.375 inches. Another specimen had outside dimensions of 5.25 by 3.875 inches with a 3.75 inch wide pull tab part and a 3 by 2.56 inch cutout window. The pull tab panel part may be made of SBS paper board stock as well.

FIG. 2 shows an edge 102 (also shown in FIG. 1) on one side of the thin, flexible part 100 in the form for instance of an exemplary printed plastic film attached onto an opposite side of the printed plastic film to form a flexible loop or belt. The attachment may for instance be made by means of double-sided tape 200 of a suitable width such as one quarter of an inch (6.35 mm) wide. The printed plastic film loop 100 is shown in FIG. 2 being slipped onto the central panel member 104 that is shown partially folded (along fold line 116) between the central subpart 104 and the window subpart 108. The exemplary film 100 formed into the loop of FIG. 2 can be viewed as a kind of endless belt or flattened (elliptical) cylinder. As shown in FIG. 3, once the loop is slipped over the central subpart 104, it is then folded further in the upward direction shown so as to be brought into parallel alignment with the window subpart 108.

As shown in FIG. 3, the pull tab panel part is attached onto an outside surface of the thin, flexible part 100 in the exemplary loop by means for instance of a double-sided tape 202 such as one-quarter inch wide double-sided adhesive tape. The central panel member with the pull tab panel part attached to the exemplary loop is thus folded into parallel alignment with the window panel member. The back panel member 110 is then further folded about the fold line 112 (between the back subpart 110 and the window subpart 108) so as to be in parallel alignment with the central subpart 104 and the window subpart 108. The window subpart is then attached to the back panel member by means for instance of folding over the top tab 118 and gluing it to the inside surface of the back subpart and folding over the bottom tab 122 and gluing it to the inside of the window subpart along the thin strip between fold line 116 and cut lines 138, 140. This bottom tab thus forms a gutter or guide rail on the backside of the central subpart for the bottom side of the pull tab part to slide on. Likewise, the top tab 118 forms a gutter or rail on the inside top of the assembly for the pull tab part to slide on.

FIG. 4 shows the assembly formed as a flat panel display assembly sleeve with the central subpart and the pull tab panel part inside the flat panel display assembly sleeve. The assembly is a sleeve that envelops the central subpart, the loop on the central subpart, and the pull tab panel part. An opening is provided on one side edge of the sleeve to allow the pull tab to be pulled out in a pull out direction. The act of pulling out the pull tab panel part causes the loop to be pulled on the side attached to the pull out tab part (facing a surface on a side of the central subpart facing a surface on the back subpart inside the sleeve) in the same direction so as to cause it to traverse around the central subpart. A cutout window on the front of the sleeve displays printed matter on the loop moving, with respect to the other side of the central subpart, in a direction opposite that of the pull out direction.

Figure 5:
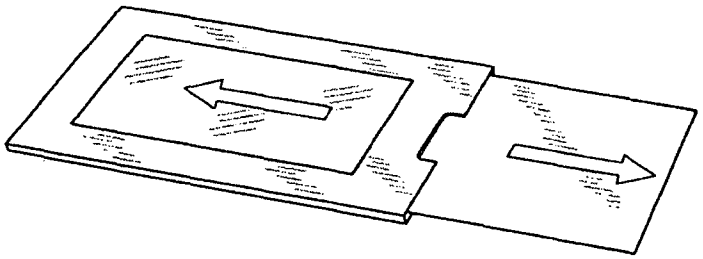
FIG. 5 shows the assembled apparatus of FIG. 4 in operation.

FIG. 5 shows the pull tab panel member being slid out of the flat panel display assembly at an open end opposite an end with the fold line between the back panel member and the window panel member so that an inside surface of the loop is slid on an outside surface of the central subpart so as to cause the printed matter on the printed plastic film to move with respect to the central subpart in traversing the cutout window of the window subpart. From the user's point of view, the printed matter/artwork moves in the opposite direction from the pull out direction of the pull out tab, as shown by the oppositely pointing arrows in FIG. 5.

Figure 6A:
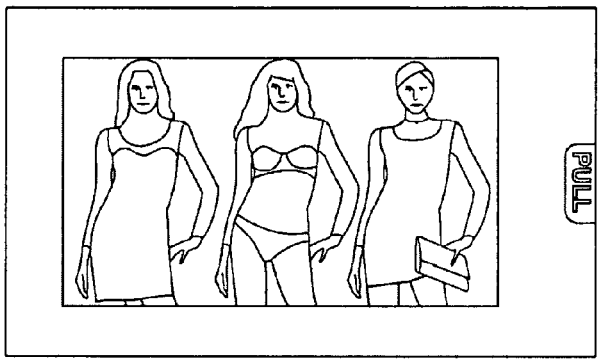
FIGS. 6A, 6B, and 6C show an effect achieved according to an embodiment of the present invention.
Figure 6B:
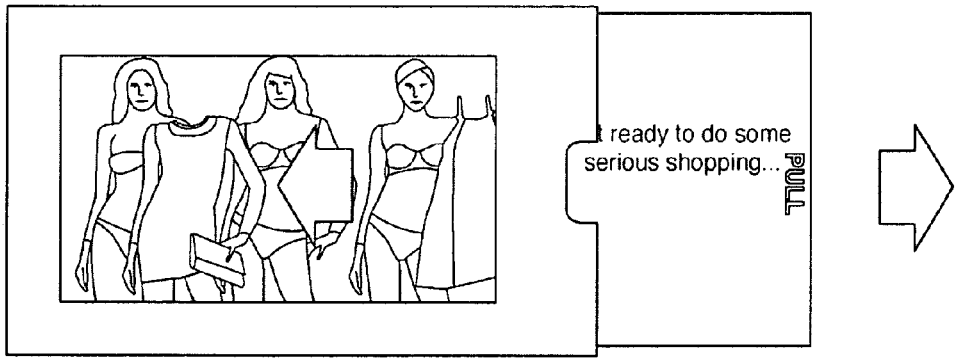
Figure 6C:
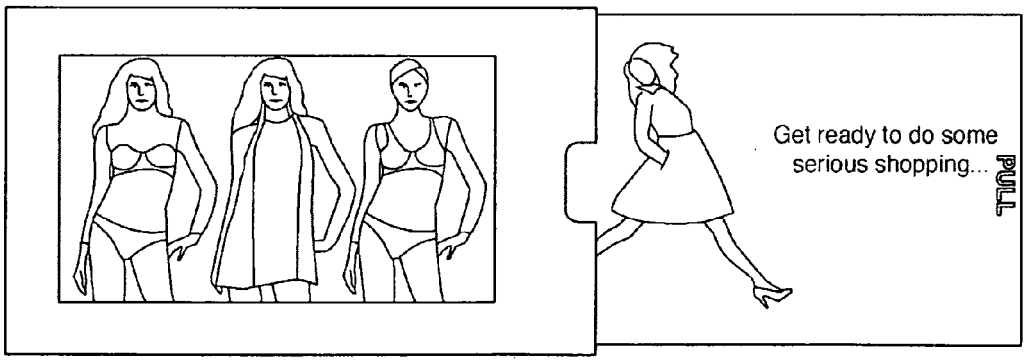

FIGS. 6A-6C show a possible retail application where models are shown trying on various outfits. FIG. 6A shows stationary imagery in the background printed on the central subpart. In this example it is three human models. Foreground imagery is printed on the thin, flexible part 100 such as the exemplary plastic film loop which is transparent in the example shown. In the example it is artwork depicting dresses for the models to "try on" by laying one of a plurality of dresses over a given model. The pull tab panel part is fully enclosed within the display assembly. FIG. 6B shows pulling the pull tab panel to the right causes the dress imagery on the film loop to scroll to the left. The pull tab is only partially pulled out at this stage but printed matter on the pull tab panel is beginning to become visible. FIG. 6C shows the pull tab panel part fully extended from within the assembly so that the imagery on the film has scrolled fully to the left while the images depicting the models remain stationary underneath.

The invention claimed is:

1. A method, comprising:

slipping a printed flexible loop onto a central subpart of a foldable panel part that is foldable along a fold line between the central subpart and a window subpart of the foldable panel part, attaching a pull tab panel part onto an outside surface of the loop, folding the central subpart with the pull tab panel part attached to the loop so as to bring the central subpart into parallel alignment with the window subpart, folding a back subpart of the foldable panel part along a fold line between the back subpart and the window subpart so as to bring the back subpart into parallel alignment with the central subpart and the window subpart, and attaching the window subpart to the back subpart so as to form a flat panel display assembly sleeve with the central subpart and the pull tab panel part inside the sleeve between the window subpart and the back subpart with the pull tab panel part slideable in and out of the flat panel display assembly sleeve at an open end opposite an end defined by the fold line between the back subpart and the window subpart so that an inside surface of the loop slides on an outside surface of the central subpart and the printed matter on the printed flexible loop moves with respect to the central subpart in traversing a cutout window of the window subpart.

2. The method of claim 1, further comprising forming the loop by attaching an edge on one side of the printed flexible loop onto an opposite side of the printed flexible loop.

3. The method of claim 1, wherein the central subpart has printed matter thereon and the film is transparent, at least in part, so that the printed matter on the printed flexible loop is caused to visibly move with respect to the printed matter on the central subpart.

4. The method of claim 1, wherein the printed matter is opaque.

5. The method of claim 1, wherein the pull tab panel part has printed matter thereon that is visible when slid out of the sleeve.

6. An apparatus, comprising:

a printed flexible loop slipped onto a central subpart of a foldable panel part that is folded along a fold line between the central subpart and a window subpart into parallel alignment with the window subpart;

a pull tab panel part attached onto an outside surface of the loop;

the central subpart with the flat pull tab panel part attached to the loop folded into said parallel alignment with the window subpart;

a back subpart of the foldable panel part folded along a fold line between the back subpart and the window subpart into parallel alignment with the central subpart and the window subpart; and the window subpart attached to the back subpart so as to form a flat panel display assembly sleeve with the central subpart and the pull tab panel part inside the sleeve between the window subpart and the back subpart with the pull tab panel part slideable in and out of the flat panel display assembly sleeve at an open end opposite an end defined by the fold line between the back subpart and the window subpart so that an inside surface of the loop is slideable on an outside surface of the central subpart to cause the printed matter on the printed flexible loop move with respect to the central subpart in traversing a cutout window of the window subpart.

7. The apparatus of claim 6, further comprising an edge on one side of the printed flexible loop attached onto an opposite side of the printed flexible loop to form the loop.

8. The apparatus of claim 6, wherein the central subpart has printed matter thereon and the film is transparent at least in part so that the printed matter on the printed flexible loop is caused to move with respect to the printed matter on the central subpart.

9. The apparatus of claim 6, wherein the printed matter is opaque.

10. The apparatus of claim 6, wherein the pull tab panel part has printed matter thereon that is visible when slid out of the sleeve.

11. A display assembly comprising a sleeve that envelops a central subpart, a loop on the central subpart, and a pull tab panel part attached to the loop, wherein an opening is provided on one side edge of the sleeve to allow the pull tab panel part to be pulled out in a pull out direction that causes the loop to be pulled in the same direction so as to cause the loop to traverse around the central subpart, wherein a cutout window on the front of the sleeve displays printed matter on the loop moving, with respect to an other side of the central subpart, in a direction opposite that of the pull out direction.

* * * * *